US010301854B2

(12) United States Patent
Christensen

(10) Patent No.: US 10,301,854 B2
(45) Date of Patent: May 28, 2019

(54) DOOR HANDLE ASSEMBLY FOR A MOTOR VEHICLE

(71) Applicant: HUF HÜLSBECK & FÜRST GMBH & CO. KG, Velbert (DE)

(72) Inventor: Mario Christensen, Muelheim (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 144 days.

(21) Appl. No.: 15/510,499

(22) PCT Filed: Aug. 10, 2015

(86) PCT No.: PCT/EP2015/068381
§ 371 (c)(1),
(2) Date: Mar. 10, 2017

(87) PCT Pub. No.: WO2016/041696
PCT Pub. Date: Mar. 24, 2016

(65) Prior Publication Data

US 2017/0260780 A1 Sep. 14, 2017

(30) Foreign Application Priority Data

Sep. 18, 2014 (DE) ..... 10 2014 113 495

(51) Int. Cl.
*E05B 85/10* (2014.01)
*E05B 81/90* (2014.01)
*E05B 81/78* (2014.01)

(52) U.S. Cl.
CPC ..... *E05B 85/107* (2013.01); *E05B 81/77* (2013.01); *E05B 81/90* (2013.01); *E05B 85/103* (2013.01); *E05B 81/78* (2013.01)

(58) Field of Classification Search
CPC ..... E05B 85/107; E05B 81/77; E05B 81/90; E05B 81/06; Y10T 292/57
See application file for complete search history.

(56) References Cited

U.S. PATENT DOCUMENTS 8,943,752 B2 * 2/2015 Thomas ..... E05B 85/10 49/394
9,249,608 B2 * 2/2016 Lang ..... E05B 85/103
(Continued)

FOREIGN PATENT DOCUMENTS

DE 10 2008 019 335 A1 10/2008
DE 10 2011 009 524 A1 7/2012
DE 10 2013 212 198 A1 1/2014

OTHER PUBLICATIONS

International Preliminary Report on Patentability of International Application No. PCT/EP2015/068381 dated Mar. 21, 2017, 16 pages.

(Continued)

*Primary Examiner* — Justin B Rephann
(74) *Attorney, Agent, or Firm* — Fay Sharpe LLP

(57) ABSTRACT

A door handle assembly for a motor vehicle includes a handle carrier, a handle part that is arranged such that it is strake-flush with a door in a resting position and projecting out of the door in an actuation position, a lever element that moves the handle part, and a transmission element. For an electrically operated normal operation, the transmission element is designed such that it can move in an entirely electrically driven manner into a first normal operation position, in which the transmission element moves the handle part into the actuation position via the lever element. The handle part can be moved and actuated in order to open the door, even in the event of a failure of the motor drive. For this purpose, for a currentless emergency operation, the transmission element is designed such that it can move from an initial position into an emergency operation position, in which the transmission element swivels the lever element at least in order to move the handle part into the actuation position.

15 Claims, 6 Drawing Sheets

(56) References Cited

U.S. PATENT DOCUMENTS

| | | | | |
|---|---|---|---|---|
| 2003/0019261 | A1* | 1/2003 | Wittwer | E05B 85/107 70/257 |
| 2011/0148575 | A1* | 6/2011 | Sobecki | E05B 85/103 340/5.64 |
| 2012/0205925 | A1* | 8/2012 | Muller | E05B 77/04 292/336.3 |
| 2013/0076048 | A1* | 3/2013 | Aerts | E05B 85/103 292/336.3 |
| 2013/0127185 | A1* | 5/2013 | Lang | E05B 81/77 292/336.3 |
| 2013/0170241 | A1* | 7/2013 | Lesueur | E05B 77/06 362/501 |
| 2014/0000167 | A1* | 1/2014 | Patel | E05B 81/34 49/32 |
| 2015/0233154 | A1* | 8/2015 | Smart | E05B 85/103 70/237 |
| 2016/0290018 | A1* | 10/2016 | Hamacher | E05B 77/42 |
| 2016/0298366 | A1* | 10/2016 | Och | E05B 85/103 |
| 2016/0369537 | A1* | 12/2016 | Rocci | E05B 85/107 |
| 2017/0292297 | A1* | 10/2017 | Bartels | E05B 85/107 |
| 2018/0058114 | A1* | 3/2018 | Brown | E05B 81/90 |
| 2018/0252009 | A1* | 9/2018 | Porada | E05B 85/107 |

OTHER PUBLICATIONS

International Search Report of International Application No. PCT/EP2015/068381 dated Nov. 18, 2015, 4 pages.

* cited by examiner

DOOR HANDLE ASSEMBLY FOR A MOTOR VEHICLE

BACKGROUND

The invention relates to a door handle assembly for a motor vehicle, having an handle mount attached to the inside of a door or hatch of the motor vehicle, a handle for opening the door or hatch of the motor vehicle, disposed such that it is strake-flush with the door or hatch when in the standby position, and protrudes from the door or hatch when in the actuation position, a lever element that moves the handle from the standby position into the actuation position and back, the first longitudinal end of which is pivotably supported on the handle mount, and the second longitudinal end of which supports the handle, and a transmission element, which is movably supported on the handle mount, and is functionally connected with the lever element, wherein, for a power driven normal operation of the transmission element from a home position into a first normal operating position, in which the transmission element moves the handle into the actuation position via the lever element, it is designed such that it can be moved entirely with electrical power, and wherein an actuation of the handle disposed in its actuation position opens a vehicle lock.

Door handle assemblies of this type for motor vehicles can be designed as inner or outer handles, wherein the present invention relates to a door handle assembly for an outer handle. There are numerous different constructions and embodiments for such door handle assemblies. The design of a door handle according to the invention relates to such constructions in which the handle mount is attached to the back surface of the door, i.e. on the inside of the motor vehicle. The handle attached to the handle mount normally protrudes outward from the door in such embodiments, and disrupts both the aesthetic appearance of the vehicle as well as the vehicle aerodynamics. In order to avoid this disadvantage, door handle assemblies are known from the prior art, in which the outer surface of the handle runs basically flush to the outer contour of the door, i.e. strake-flush, when the handle is in its standby position. A handle of this type can be transferred into an actuation position for opening the door or a vehicle lock, in which the handle protrudes from the outer contour of the door.

A door handle assembly of the type indicated in the introduction is known, by way of example, for electric automobiles from Tesla Motors Inc. as well as from DE 10 2013 212 198 A1. This known door handle assembly has a handle that is strake-flush when in its standby position, which can be moved in a motor driven manner from the standby position into an actuation position. A handle of this type is preferably used in electric automobiles in which the handle extends exclusively with a power driven drive from its strake-flush standby position, in which the handle is disposed in order to reduce wind resistance, into the actuation position when a legitimized user of the vehicle approaches. As soon as the handle is no longer needed, it retracts back into the standby position and thus disappears into the body, in order to not generate any air resistance. The disadvantage is that the handle can no longer be driven if the motor drive malfunctions, and an opening of the door is nearly impossible, which is quite problematic for safety reasons.

The invention addresses the objective of providing a solution that results in a structurally simple door handle assembly, which can be produced inexpensively, and with which the handle can also be driven when the motor drive malfunctions, and can be actuated in order to open the door.

BRIEF SUMMARY

With a door handle assembly of the type specified in the introduction, the objective is achieved according to the invention in that, for a powerless emergency operation, the transmission element is designed such that it can be moved from the home position into an emergency operating position, in which the transmission element pivots the lever element in order to at least move the handle into the actuation position.

Advantageous and useful designs and developments of the invention can be derived from the dependent Claims.

A door handle assembly of a motor vehicle is created by the invention, which is distinguished by a functional construction and has a compact and inexpensive design. With the door handle assembly according to the invention, the movement of the transmission element ensures, both in the power driven normal operation as well as in the powerless emergency operation, that the handle ends up in the actuation position, in which it protrudes from the door or hatch of the vehicle, and can be actuated or manipulated by a user to open the door lock. It is thus also possible to open the door or hatch of the vehicle with the door handle assembly according to the invention entirely manually when the power supply malfunctions. As a result, the door handle assembly is fully functional in an emergency as well, such as a powerless emergency operation, and the greatest level of aerodynamic advantages is nevertheless ensured in normal operation.

A structurally particularly simple possibility for ensuring that an actuation of the handle opens the vehicle lock is achieved in the design of the invention in that an opening lever that is rotatably supported on the handle mount is coupled to the lock, wherein an actuation of the handle disposed in its actuation position moves the opening lever from a neutral position into an opening position that opens the lock.

For the power driven normal operation of the door handle assembly, it is provided in the design of the invention that the door handle assembly has at least one drive, which at least moves the transmission element from the home position into the first normal operating position in the power driven normal operation thereof. As a result of the power driven movement of the transmission element, the lever element movably coupled to the transmission element is pivoted at its first longitudinal end, by means of which the handle is extended into the actuation position, and protrudes from the door or hatch.

In order to increase the convenience of the door handle assembly according to the present invention, it is advantageous in a further design when at least one proximity sensor is disposed in the handle and/or on the handle mount, which is designed such that it is connected to the drive for data transfer, in order that, when in the power driven normal operation, the drive is activated when the proximity sensor detects the proximity or touch of a legitimized user, and it then moves the transmission element from the home position into the first normal operating position.

With the door handle assembly according to the invention, the convenience can be further improved when the at least one proximity sensor redirects the lock from a locked setting into an unlocked setting in the power driven normal operation, when a legitimized or authorized user approaches or touches the handle. This makes it possible to access the vehicle without a key.

In order to ensure that the user does not have to exert any excess manual force in order to open the lock in the power driven normal operation, the invention provides in a further design that a detection means is provided, which is designed such that it is connected to the drive for data transfer, such that in the power driven normal operation, when a manual actuation of the handle disposed in its actuation position has been detected, the detection means activates the at least one drive for moving the transmission element from the first normal operating position into a second normal operating position, in which the transmission element interacts with the opening lever that opens the vehicle lock. The opening of the lock occurs accordingly in the power driven normal operation with the assistance of the drive, which increases the convenience for the user.

A structurally particularly compact and space-saving design can be achieved with further designs of the door handle assembly according to the invention, in that the opening lever is non-rotatably attached to a gearwheel rotatably supported on the handle mount, wherein the gearwheel engages with a gear rack supported on the transmission element.

In another design it is advantageous when the gear rack moved by the transmission element for at least a portion of its movement path drives the gearwheel when the transmission element is moved from the first normal operating position into the second normal operating position, and forces the opening lever into the opening position. A movement of the transmission element in the power driven normal operation thus moves the gear rack, by means of which the gearwheel engaging with the gear rack is rotated, on which the opening lever is non-rotatably attached, such that ultimately, the opening lever pivots into its opening position, and thus opens the lock.

The transmission element moves along the handle mount, from the home position into the second normal operating position via the first normal operating position, wherein, however, a moving coupling between the transmission element and the gear rack (ultimately in order to deflect the opening lever) is only desired between the first and second normal operating positions, but not between the home position and the first operating position. For this reason, the invention provides, in a further design of the door handle assembly, that the gear rack has a movement pin, which is inserted in a recess in the transmission element, wherein the gear rack can move in the recess in relation to the transmission element.

The invention provides in another design that the transmission element is pretensioned in the direction of the first emergency operating position, and a latching means is pivotably supported on the transmission element, which blocks a movement of the transmission element from the home position toward the emergency operating position when in the latched position. The transmission element is thus pretensioned toward the emergency operating position, for which a spring element can be used, for example, in order that an automatic movement of the transmission element from the home position is possible during a powerless emergency operation.

In a further design of the invention, it is provided that the handle can be moved from the strake-flush standby position into a recessed releasing position in the door or hatch during the powerless emergency operation. By way of example, the latching means can be moved from its latching position into the releasing position such that a movement of the transmission element toward the emergency operating position is possible.

In order that this movement of the transmission element toward the emergency operating position occurs in a controlled manner, and not randomly, it is provided in the design of the invention that a releasing projection formed on the lever element that extends over the first longitudinal end, which defines a pivot axis for the lever element, and forces the latching means out of its latching position when in the releasing position, such that the transmission element pretensioned toward the emergency operating position can move into the emergency operating position.

A structurally particularly simple possibility for moving the handle from its standby position exists for both the power driven normal operation as well as for the powerless emergency operation in that the transmission element moves the releasing projection along a first deflection surface when it moves from the home position toward the first normal operating position, and it moves the releasing projection along a second deflection surface when it moves from the home position toward the emergency operating position, such that the lever element pivots about the pivot axis and the handle moves into the actuation position. The respective deflection surface of the transmission element ensures that the lever element is pivoted, and as a result, the handle is pushed outward, such that it protrudes from the door or hatch, and can be manipulated by a user.

Accordingly, the invention provides in a further design of the door handle assembly that the first deflection surface and the second deflection surface are each designed as a surface running at an angle away from the handle mount, which forces the releasing projection away from the handle mount when the transmission element is moved into the first normal operating position or into the emergency operating position, and as a result, pivots the handle into the actuation position.

In order to also be able to open the lock of the door handle assembly in a powerless emergency operation, the invention provides in a further design that the handle is coupled or attached to the opening lever via a manipulation element in a functional manner, such that in the powerless emergency operation, the handle forces the manipulation element against the opening lever through an actuation of the handle disposed in its actuation position, and moves it from the neutral position into the open position.

Structurally, it is of particular advantage when the movements of the transmission element are substantially identical for both operating states. Accordingly, the invention provides that the movement of the transmission element from the home position into at least the first normal operating position is a linear movement, which runs in the opposite direction as the movement of the transmission element from the home position into at least the emergency operating position. Consequently, the home position represents a. type of middle position, from which the transmission element moves into either the power driven normal operation toward the first normal operating position, or into the powerless emergency operation toward the first emergency operating position, wherein there is a single linear movement path for both movements, and the home position of the transmission element is provided at the middle of the movement path.

Lastly, the invention advantageously provides that an emergency lock cylinder is attached to the handle mount, which can be accessed from the outside with a mechanical emergency key when the handle is in the actuation position in order to unlock the lock. In this manner, the lock can then be unlocked, before it is to be opened manually.

As a matter of course, the features specified above and still to be explained below can be applied not only in the respective given combinations, but also in other combinations or in and of themselves, without abandoning the scope of the present invention. The scope of the invention is defined only by the Claims.

BRIEF DESCRIPTION OF THE DRAWINGS

Further details, features and advantages of the subject matter of the invention can be derived from the following description in conjunction with the drawings, in which a preferred exemplary embodiment of the invention is depicted in an exemplary manner. Therein.

DETAILED DESCRIPTION

Figure 1:
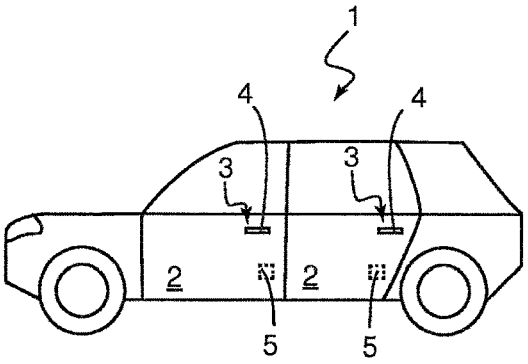
FIG. 1 shows a side view of a motor vehicle having numerous door handle assemblies according to the invention.

A vehicle, or motor vehicle 1 in the form of a passenger car is depicted by way of example in FIG. 1, which has four doors 2 in the example (two of which are visible in FIG. 1), which can be opened via a door handle assembly 3 and in particular using a door handle, or handle 4. The doors 2 are securely closed via a respective lock 5, and can only be opened from the outside via a respective movement of the handle 4. This movement of the handle 4 can be comprised of a pulling and/or pivoting movement, wherein the movement of the handle 4 is transmitted to the corresponding lock 5. The corresponding lock 5 and thus the associated door 2 can then be opened through the movement of the handle 4.

The door handle assembly 3 according to the invention is shown in greater detail in various views in FIGS. 2 to 23 for various positions of the individual components in relation to one another, and for various operating states, which shall be explained in detail below.

Figure 2:
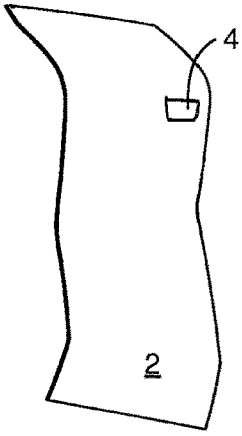
FIG. 2 shows a perspective view of a door having a strake-flush handle disposed therein.
Figure 3:
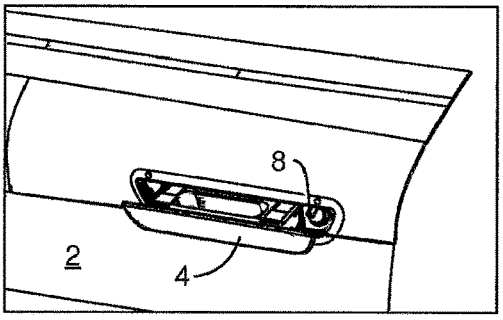
FIG. 3 shows an enlarged, perspective view of the door with the handle extended.

FIGS. 2 and 3 each show the door 2 and the handle 4 serving to open the door 2 in a perspective view. The handle 4 is disposed basically flush with the outer contour of the door 2, thus strake-flush therewith, in FIG. 2. It is in a standby position here, in which is not being used. The handle 4 can be transferred from the standby position shown in FIG. 2 into an actuation position shown in FIG. 3, in which the handle 4 protrudes in relation to the outer contour of the door 2. Accordingly, the handle 4 is disposed such that it protrudes from the door 2 when it is in its actuation position. A user can actuate or manipulate the handle 4 when it is in this protruding or extracted actuation position in order to open the door 2 or the vehicle lock 5. According to the present invention, the transition of the handle 4 from the standby position into the operating position can occur in either a power driven normal operation by means of a suitable drive means, or in a powerless emergency operation by means of a manual actuation by the user.

Figure 4:
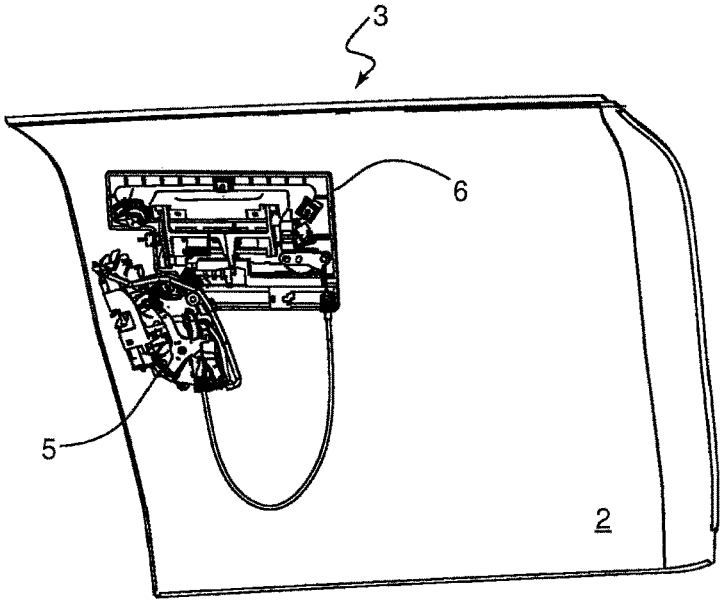
FIG. 4 shows a rear view of the door with the handle mount attached thereto, and a lock assembly.
Figure 5:
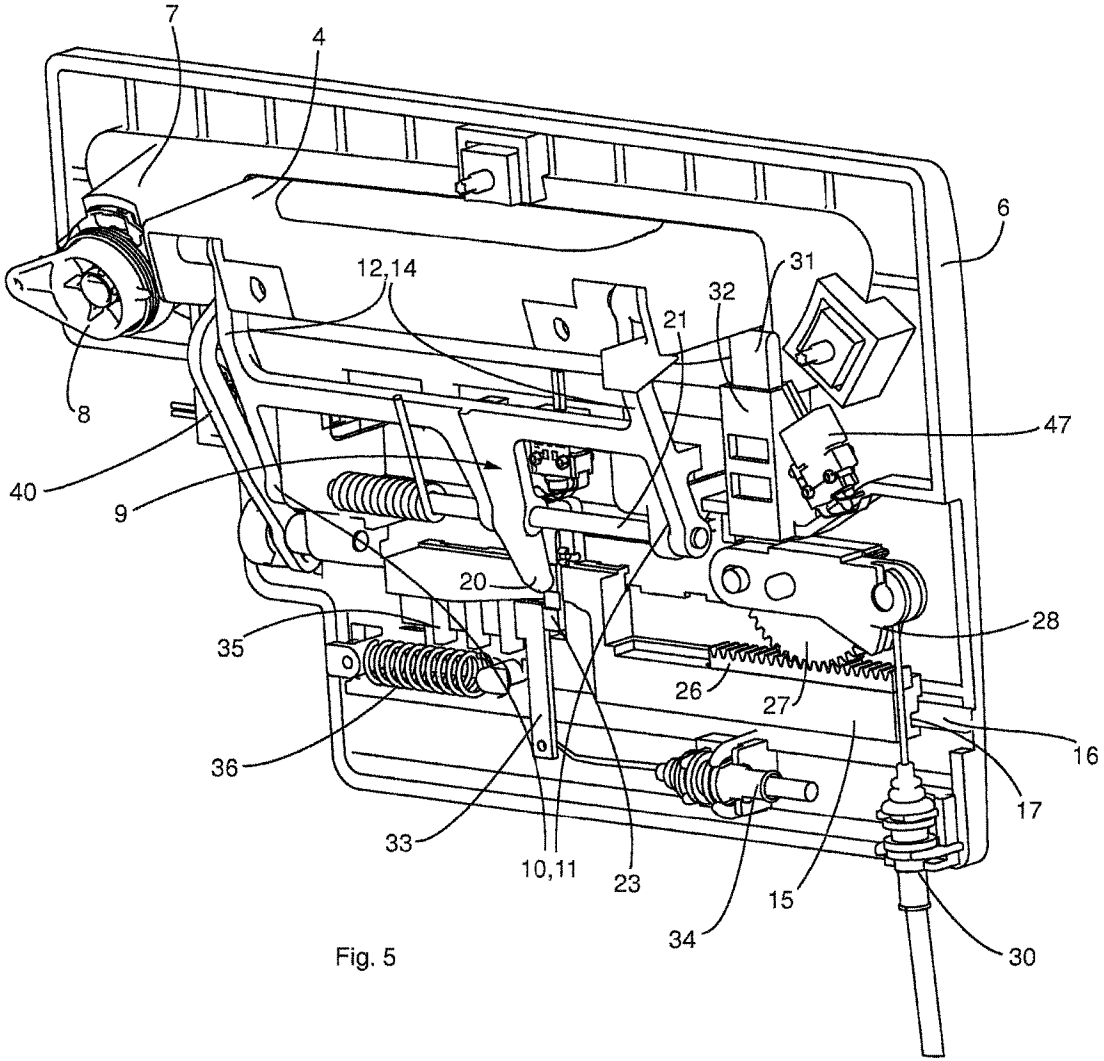
FIG. 5 shows an enlarged view of the door handle assembly without the door.

As can be derived from FIGS. 4 and 5, for example, the door handle assembly 3 has a frame-like handle mount 6. The handle mount 6 serves in the known manner for mounting the handle 4, which is disposed in its standby position in FIG. 5. The handle mount is attached to the inside of the door 2, thus in the interior of the door 2, by means of screw connections, not shown in detail. The door mount 6 is formed substantially by a framework structure thereby, in order to save on material, which has numerous receiving and bearing chambers, in order to accommodate the handle 4, among other things, which is to be used for opening a corresponding door 2 of the motor vehicle 1, or for opening the vehicle lock 5, respectively.

By way of example, the door mount 6 has a receiving chamber 7 next to the handle 4, in which an emergency lock cylinder 8 can be inserted, such that the emergency lock cylinder 8 is attached to the handle mount 6. The emergency lock cylinder 8 can be accessed from the outside with a mechanical emergency key for unlocking the lock 5 when the handle 4 is in the actuation position, as is shown by way of example in FIG. 3.

As can be derived in particular from FIG. 5, the handle 4 is not supported directly on the handle mount 6. Instead, the handle 4 is supported by a lever element 9, which has an H-shaped design. Two bearing arms 10 of the H-shaped lever element 9 define a first longitudinal end 11 of the lever element 9, while in contrast, two retaining arms 12 define a second longitudinal end 14 of the lever element 9. The first longitudinal end 11, or the bearing arm 10 of the lever element 9 is pivotably supported on the handle mount 6 thereby, such that the handle 4 can be moved from the standby position into the actuation position and back. In particular, the two bearing arms 10 are supported on the handle mount such that they can pivot via a pivotal axis 21. Conversely, the second longitudinal end 14, or the retaining arms 12, respectively, of the lever element 9, accommodate the handle 4.

FIG. 5 further shows that a transmission element 15 is moveably supported on the handle mount 6. The transmission element 15 has a recess 17 into which a bar 16 formed on the handle mount 6 extends, by means of which the transmission element 15 can be moved laterally in relation to the handle mount 6. The transmission element 15 is depicted in detail in FIGS. 6, 7 and 8, and has a first deflection surface 18 and a second deflection surface 19, which serve to guide a releasing projection 20 formed on the lever element 9, which extends outward between the two bearing arms 10 and beyond the first longitudinal end 11. The two deflection surfaces 18 and 19 can be seen particularly well in the top view of the transmission element 15 in FIG. 8.

The transmission element 16 has an opening 22 (see FIG. 7) between the first deflection surface 18 and the second deflection surface 19, in which a latching means 23 is pivotally retained. The latching means 23 can block a movement of the transmission element 15, for which it engages with the handle mount 6, as shall be explained in detail below.

The transmission element 15 furthermore has a recess 24 (see FIGS. 7 and 8, by way of example), which is formed in its upper surface. The recess 24 serves to receive a movement pin 25, which is formed on the undersurface of a gear rack 26. As a result, the gear rack 26 is inserted with its movement pin 25 into the recess 24, and can move in the recess 24, such that the gear rack 26 can move in relation to the transmission element 15 and laterally in relation to the handle mount 6.

Figure 6:
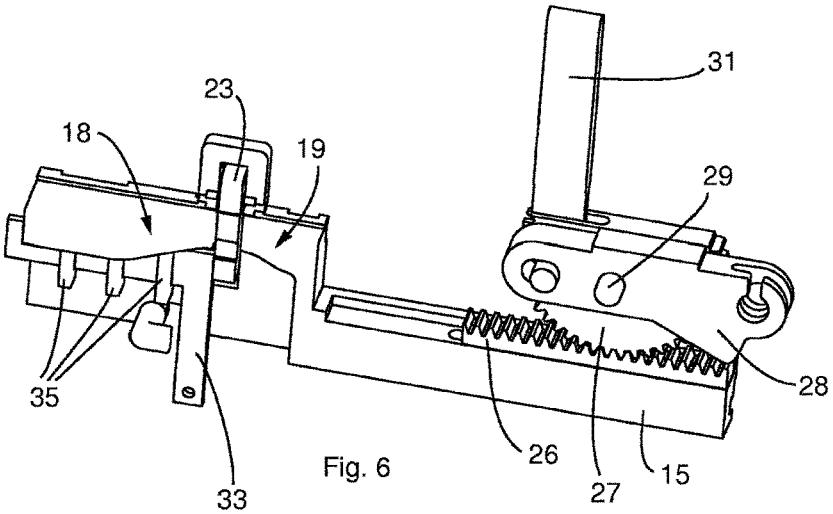
FIG. 6 shows an arrangement of the door handle assembly having a transmission element in a perspective view.
Figure 7:
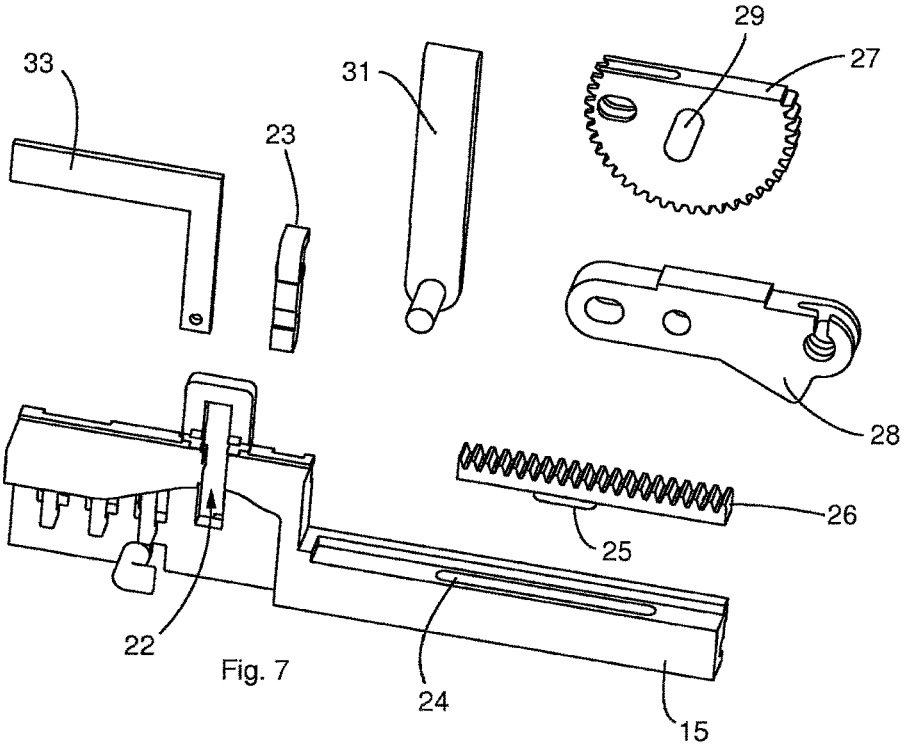
FIG. 7 shows a perspective exploded view of the arrangement from FIG. 6.
Figure 8:
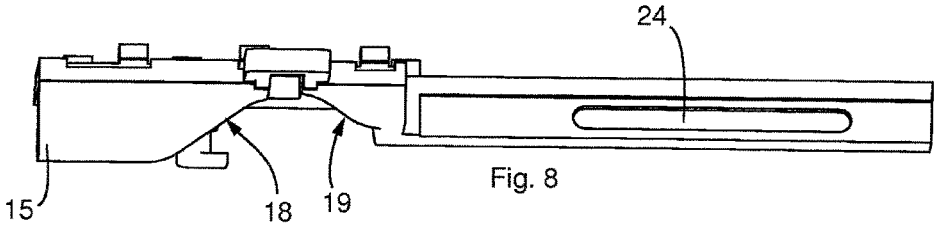
FIG. 8 shows a top view of the transmission element from FIGS. 6 and 7.

As can further be derived from FIGS. 5 and 6, the gear rack 26 engages with the teeth of a gearwheel 27. The gearwheel 27 is rotatably supported on the handle mount 6 thereby, and has the form of just a circle segment. The circle segment design makes it more compact, and reduces the installation space, and is possible because the gearwheel 27 does not need to fully rotate in the operation thereof. Furthermore, an opening lever 28 is non-rotatably attached to the gearwheel 27, such that the opening lever 28 can rotate together with the gearwheel 27 about the axis 29 of the gearwheel 27. As a result, the opening lever 28 is also rotatably supported on the handle mount 6, and is furthermore coupled to the lock 5 via a Bowden cable 30 (see FIG. 5). The opening lever 28 can be moved from a neutral position into an opening position that opens the lock 5.

A movement of the opening lever 28 from its neutral position into the opening position that opens the lock 5 can be obtained through a movement of the gear rack 26, by means of which the gearwheel 27 is rotated about the axis 29, resulting in the opening lever 28 non-rotatably attached to the gearwheel 27 being pivoted accordingly. The pivoting of the opening lever 28 can also be realized using a manipulating element 31, which is moveably retained on the handle mount 6. More precisely, the manipulating element 31 extends inside a guide channel 32, which is formed on the handle mount 6, and enables a linear movement of the manipulation element 31 toward the opening lever 28. The manipulation element 31 is eccentrically attached at a first end to the gearwheel 27 and at the end to the opening lever 28, such that a movement of the manipulating element 31 directed toward the gearwheel 27 causes a pivoting of the opening lever 28 and a simultaneous rotation of the gearwheel (in a counterclockwise direction in FIG. 5).

Furthermore, a drive angle 33 is attached to the transmission element 15. The drive angle 33 is laterally inserted in a retaining means 35 of the transmission element 15, and connected to an actuator via the Bowden cable 34. The drive angle 33 serves to move the transmission element 15 in a power driven normal operation, wherein the latching means 23 must be disposed in its latched position for this, because the latching means 23 serves as a bearing surface for the drive angle 33, which would otherwise be pulled out of the retaining means 35 by a pulling movement of the Bowden cable 34. The drive angle 33 is not designed for a movement of the transmission element 15 toward the left in FIG. 5 (thus for a movement away from the gearwheel 27). The drive angle 33 is only designed for a movement of the transmission element 15 toward the right, thus toward the gearwheel 27.

The functioning of the door handle assembly 3 according to the invention shall now be explained based on the FIGS. 1 to 8 described above, in conjunction with FIGS. 9 to 23. The door handle assembly 3 is distinguished in that, in addition to its power driven normal operation, it can also be used by a user in an emergency in a powerless emergency operation. Merely a mechanical emergency key is needed for opening the lock 5 in the powerless emergency operation, which an authorized or legitimized user has as a matter of course.

Figure 9:
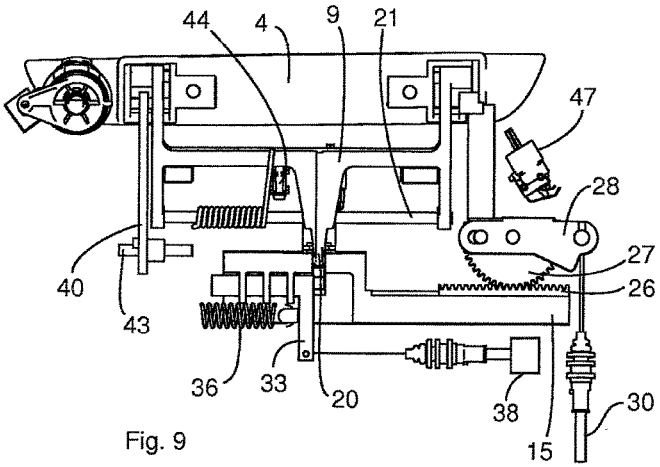
FIG. 9 shows a schematic rear view of the arrangement of components of the door handle assembly with the handle in the standby position.
Figure 10:
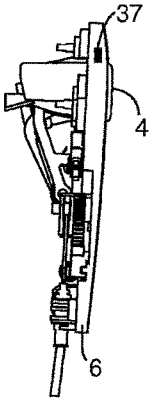
FIG. 10 shows a side view of the arrangement in FIG. 9.

FIGS. 9 to 14 shows various depictions of the power driven normal operation, wherein different functional positions are also shown therein. Thus, by way of example, a home position of the door handle assembly 3 is shown in FIGS. 9 and 10, in which the handle 4 is disposed in a standby position that is strake-flush to the outer contour of the door 2, the transmission element 15 is located in a home position, the opening lever 28 is located in a neutral position, and the latching means 23 is located in a latching position. When the transmission element 15 is in the home position, the releasing projection 20 is disposed in the middle between the first and second deflection surfaces 18, 19, such that the lever element 9 is not pivoted and consequently the lever element 9 retains the handle 4 in the standby position. When the latching means 23 is in the latching position it prevents a movement of the transmission element 15 away from the gearwheel 27. This is because the transmission element 15 is pretensioned by means of a spring element 36 in a direction directed away from the gearwheel 27, such that the latching means 23 prevents the spring element 36 from pulling the transmission element 15 toward it. The spring element 36 is attached at one end to the handle mount 6, while the other end is attached to the transmission element 15. In contrast, when the latching means 23 is in its latching position it allows for a movement of the transmission element 15 toward the gearwheel 27, wherein the force of the spring element 36 is overcome for this.

Figure 11:
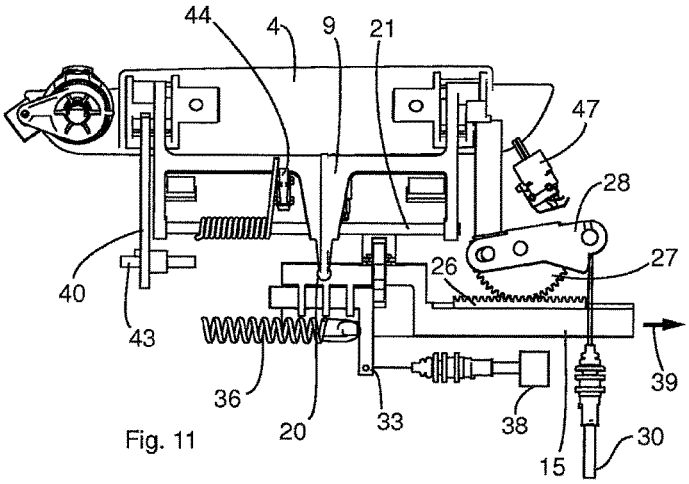
FIG. 11 shows a schematic rear view of the arrangement of components of the door handle assembly for the power driven normal operation, with the handle in the actuation position.
Figure 12:
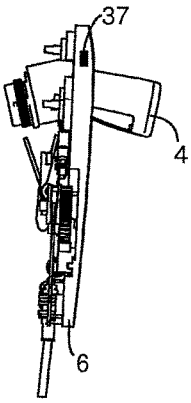
FIG. 12 shows a side view of the arrangement in FIG. 11.
Figure 13:
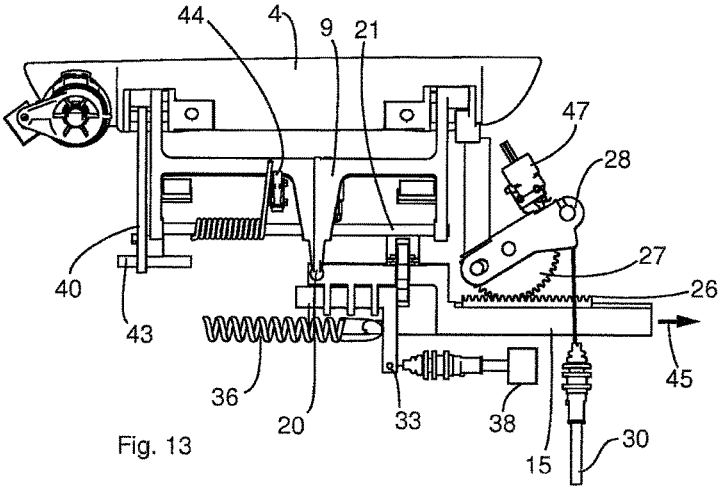
FIG. 13 shows a schematic rear view of the arrangement of components of the door handle assembly for the power driven normal operation, with an actuated handle.
Figure 14:
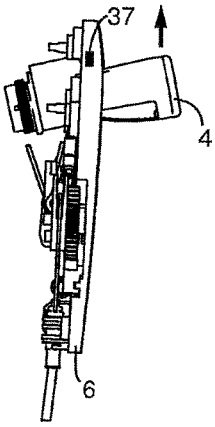
FIG. 14 shows a side view of the arrangement from FIG. 13.
Figure 15:
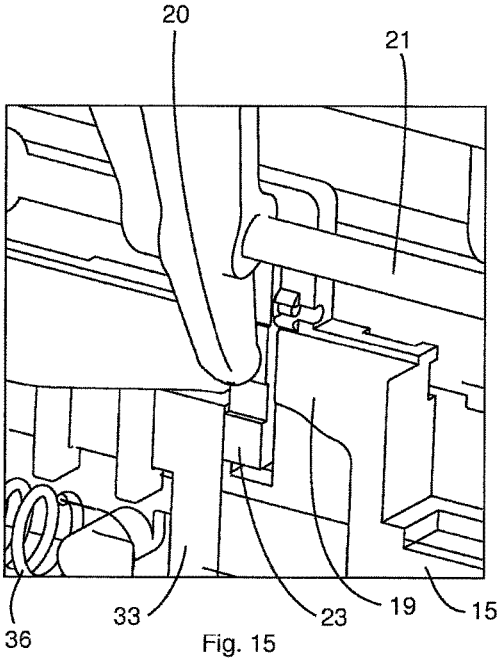
FIG. 15 shows an enlarged view of the door handle assembly with the handle in the standby position.
Figure 16:
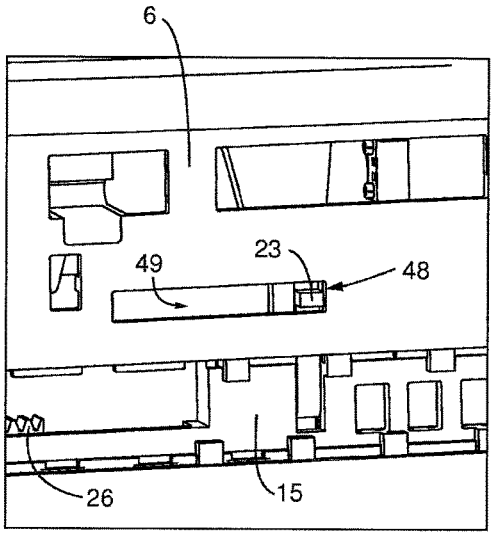
FIG. 16 shows an enlarged rear view of the door handle assembly with the handle in the standby position.
Figure 17:
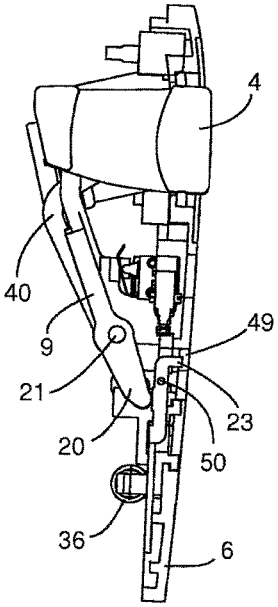
FIG. 17 shows a side sectional view of the door handle assembly with the handle in the standby position.

When the handle 4 is located in the standby position, and an authorized or legitimized user approaches the vehicle or the handle 4, this is detected by a proximity sensor 37 in the power driven normal operation of the door handle assembly 3. The proximity sensor 37 is depicted schematically in FIGS. 10, 12 and 14, and disposed in the handle mount 6 in the illustrated exemplary embodiment, wherein alternatively, the proximity sensor 37 could also conceivably be disposed in the handle 4. The proximity sensor 37 is designed such that it can exchange data with a drive 38, which can be servomotor or an actuator, and is merely schematically depicted in FIGS. 9, 11 and 13. This means that in the power driven normal operation, the proximity sensor 37 activates the drive 38 when the proximity or touch of a legitimized user has been detected, and this then moves, or pulls, the transmission element 15 from the home position into a first normal operating position, which is shown in FIGS. 11 and 12. In particular, the drive 38 pulls on the drive angle 33 via a pulling mechanism, such that the transmission element 15 is moved into the first normal operating position. This movement of the transmission element 15 occurs counter to the force of the spring element 36 and toward the gearwheel 27, as indicated by the arrow 39 in FIG. 11. When the transmission element 15 is moved into the first normal operating position, the first deflection surface 18 comes to bear on the releasing projection 20 of the lever element 9. The first deflection surface 18 forces the releasing projection 20 away from the handle mount 6, by means of which the lever element 9 pivots about the pivot axis 21, and the handle 4 moves into its actuation position. In the extracted actuation position, a user can then actuate the handle 4 in order to open the door 2, wherein the extracting of the handle 4 into the actuation position occurs entirely electrically by means of the drive 38 for the power driven normal operation, without the user having to exert any force. As can further be derived from FIG. 11, the gear rack 26 moves in relation to the transmission element 15 when the transmission element 15 is moved from the home position into the first normal actuation position. The opening lever 28 remains practically entirely stationary during this movement—at least the lock 5 is not yet opened when it is moved into the first normal operating position, because the deflection of the opening lever 28 that can be seen in FIG. 11 is not sufficiently large enough for this.

In order to open the lock 5, the user must actuate the handle 4 disposed in the actuation position (see FIG. 12), in that he pulls it upward in the depicted exemplary embodiment. The handle 4 can thus not only be extended by means of the lever element 9, but it can also be rotated upward or outward using a rocker arm 39 (see FIG. 19, by way of example), wherein, alternatively, a downward rotational movement of the handle 4 is also conceivable. The handle 4 is rotatably supported on the first longitudinal end of the rocker arm 39, wherein a bearing pin 42 of the handle mount 6 can move inside a guide recess 41 formed on the second longitudinal end of the rocker arm 39, by means of which, in particular, the second longitudinal end of the rocker arm 39 can move in relation to the handle mount 6 (see FIGS. 21 and 23, by way of example, which show the rocking movement of the handle 4 for the powerless emergency operation, wherein the rocking movement for the power driven normal operation is identical). The user does not have to exert any excessive force on the handle 4 in order to open the lock 5 in the desired manner. Rather, a slight rocking movement of the handle 4 disposed in the actuation position of 1°, for example, is sufficient. This is because a detection means 43, which can be a micro-switch, for example, is actuated through this slight rocking movement of the handle 4, which is connected such that it can exchange data with the drive 38, such that an actuation of the detection means 43 activates the drive 38. As a result, the drive 38 moves the transmission element 15 from the first normal operating position into a second normal operating position when in the power driven normal operation (see FIGS. 13 and 14, by way of example). As a result of the further movement of the transmission element 15, indicated by the arrow 45, the releasing projection 20 remains kept apart from the handle mount 6, wherein it is not, however, pushed further away when moved from the first normal operating position into the second normal operating position. The movement pin 25 of the gear rack 26 then lies, however, against the left-hand longitudinal end of the recess 24 in the transmission element 15 when the transmission element 15 is moved from the first normal operating position into the second normal operating position, such that when the transmission element 15 is moved in the direction of the arrow 45, the gear rack 26 is moved with it. When the transmission element 15 is moved from the first normal operating position into the second normal operating position, the gear rack 26 moved by the transmission element 15, together therewith, at least for a portion of its movement path, drives the gearwheel 27, and forces the opening lever 28 into the open position. Thus, the gearwheel 27, the teeth of which engage with the teeth of the gear rack 26, is moved counter clockwise. The rotation of the gearwheel 27 causes the opening lever 28 that is non-rotatably supported on the gearwheel 27 to pivot. The pivotal movement of the opening lever 28 in turn causes a pulling of the Bowden cable 30 connected to the lock 5, by means of which the lock 5 is ultimately opened. The drive 38 moves the transmission element 15 thereby, until the opening lever 28 actuates a micro-switch 47, which is coupled to the drive 38 such that the actuation of the micro-switch 47 by the opening lever 28 stops the drive 38, by means of which the opening procedure for the lock 5 is completed in the power driven normal operation thereof.

After the lock 5 is opened, the drive 38 can retract in the power driven normal operation, such that the transmission element 15 is forced back toward the home position by the force of the spring element 36. By way of example, the drive 38 can retract far enough that the opening lever 28 is again disposed in the neutral position, i.e. the transmission element 15 is returned to the first normal operating position. In contrast, the door handle can then still be extracted, and first be returned to the standby position based on a signal from the vehicle 1, e.g. when the vehicle motor is started up.

If there is a malfunction of the electrical supply in the vehicle 1, or the motor drive 38 malfunctions, the transmission element 15 can no longer be driven in order to extract the handle 4 and move the opening lever 28 into the opening position for opening the door 2 or the lock 5. In other words, a power driven normal operation of the door handle assembly 3 is no longer possible. In accordance with the invention, however, the door handle assembly 3 is designed such that it can also enable a powerless emergency operation without electricity, by means of which, with only a manual actuation by a user, the lock 5 of a door 2 of a vehicle 1 can be opened. The powerless emergency operation of the door handle assembly 3 shall be explained below with reference to FIGS. 15 to 23.

FIGS. 15, 16 and 17 again show the home position of the door handle assembly 3, in which the handle 4 is disposed in the standby position, the transmission element 15 is disposed in the home position, the opening lever 28 is disposed in the neutral position, and the latching means 23 is disposed in the latching position. As has already be explained above for the power driven normal operation, the latching means 23 prevents a movement of the transmission element 15 in one direction, which is opposite the direction toward the gearwheel 27. The blockade is generated by the latching means 23, in that it bears on a limit surface 48 (see FIG. 16) of the handle mount 6. In this manner, the transmission element 15 with the latching means 23 attached to it is prevented from moving away from the gearwheel 27. A movement toward the gearwheel 27 is possible however, because the handle mount 6 has a movement recess 49, such that when the latching means 23 is in its latching position, the transmission element 15 can move in the power driven normal operation together with the latching means 23 out of the home position via the first normal operating position into the second normal operating position.

Figure 18:
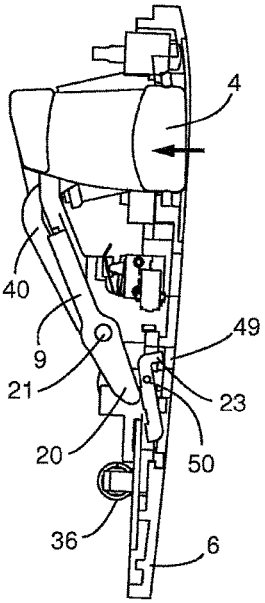
FIG. 18 shows a side sectional view of the door handle assembly for a powerless emergency operation, with the handle in the unlocked position.
Figure 19:
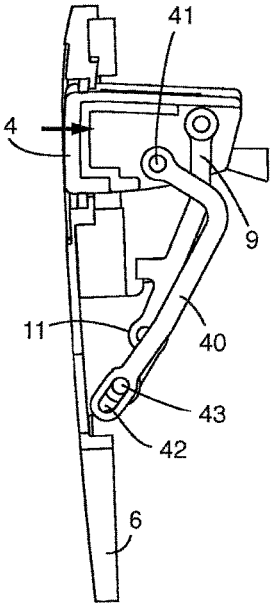
FIG. 19 shows another side sectional view of the door handle assembly for the powerless emergency operation, with the handle in the unlocked position.

In the powerless emergency operation, a user then manually pushes the handle 4 in a first step toward the vehicle interior, as is indicated in FIGS. 18 and 19 by the respective arrow. In other words, the handle 4 can be moved in the powerless emergency operation from the strake-flush standby position into a releasing position in which it is recessed into the door 2. The two FIGS. 18 and 19 show different lateral cutaway views of the handle mount 6 with the components supported thereon and attached thereto. The inward directed force applied to the handle 4 by the user causes the lever element 9 to pivot about the pivot axis 21 via the recessed handle 4, by means of which the releasing projection 20 extending over the first longitudinal end 11 and the pivot axis 21 of the lever element 9 is moved toward the handle mount 6. As long as the transmission element 15 is located in the home position, in which the releasing projection 20 is disposed between first and second deflection surfaces 18, 19, the releasing projection 20 pushes against the latching means 23 and rotates it about its rotational axis 50 (see FIGS. 17 and 18, by way of example) such that the latching means 23 is moved out of its latching position, and disengages from the handle mount 6, as is illustrated in FIG. 18.

Because the latching means 23 then no longer bears on the limit surface 48 of the handle mount 6, a movement of the transmission element 15 away from the gearwheel 27 rotatably supported on the handle mount 6 is possible. The spring element 36 pulls the transmission element 15 away from the gearwheel 27, and moves the transmission element 15 into an emergency operating position (see FIGS. 20 and 21), when the latching means 23 is moved out of its latching position. In other words, the transmission element 15 is pretensioned toward the emergency operating position, wherein a latching means 23 is pivotably supported on the transmission element 15, which blocks a movement of the transmission element 15 from the home position toward the emergency operating position when it is in its latching position.

Figure 20:
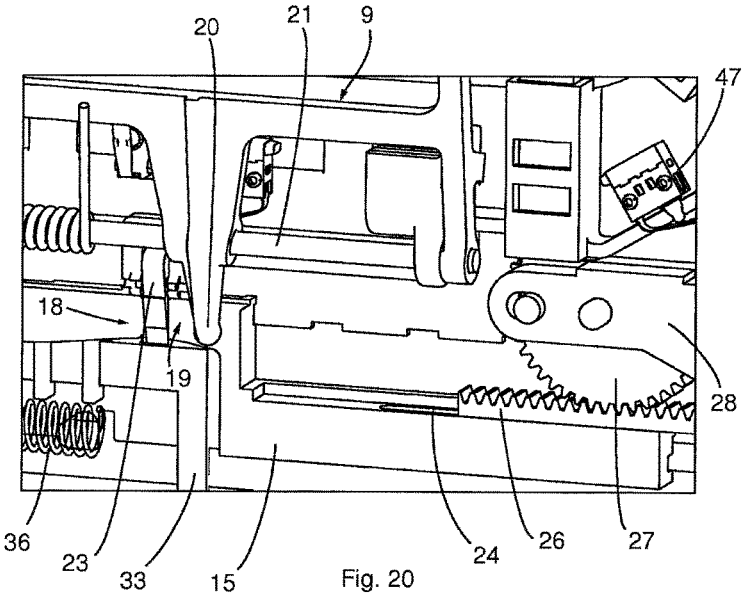
FIG. 20 shows an enlarged view of components of the door handle assembly for the powerless emergency operation with the handle in the actuation position.
Figure 21:
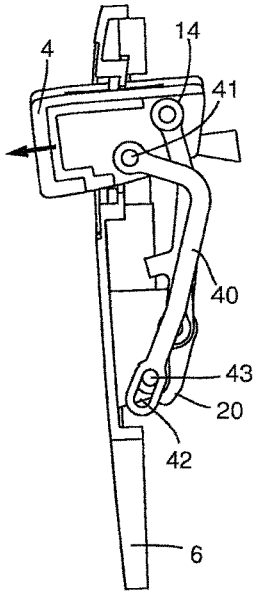
FIG. 21 shows a side sectional view of the door handle assembly from FIG. 19.

As can be seen in FIG. 20, the releasing projection 20 moves along the second deflection surface 19 when the transmission element 15 moves from the home position into the emergency operating position, causing a pivoting of the lever element 9 about the pivot axis 21, which in turn leads to the handle 4 supported on the second longitudinal end 14 of the lever element 9 being deflected into the actuation position, in which it protrudes from the door 2 of the vehicle 1. With this movement of the transmission element 15, the movement pin 25 of the gear rack 26 moves in the recess 24 of the transmission element 15 in relation thereto, without the opening lever 28 being moved out of its neutral position. Consequently, the transmission element 15 moves the releasing projection 20 along the second deflection surface 19 when it moves from the home position toward the emergency operating position, such that the lever element 9 pivots about the pivot axis 21, and the handle 4 moves into the actuation position. Thus, the manual pushing of the handle 4 inward by a user causes the handle 4 to be deflected automatically, and without a power driven drive 38, into the actuation position.

It is the case that for both the power driven normal operation as well as for the powerless emergency operation, the first deflection surface 18 and the second deflection surface 19 are each designed as a surface running at a diagonal away from the handle mount 6, which force the releasing projection 20 away from the handle mount 6 when the transmission element 15 is moved into the first normal operating position or into the emergency operating position, and consequently pivots the handle 4 into the actuation position, in which a user can actuate or manipulate it, in order to open the lock 5. Likewise, it is the case that for the normal operation and the emergency operation, the movement of the transmission element 15 from the home position is a linear movement, at least in the emergency operating position, which runs in a direction opposite to the movement of the transmission element 15 from the home position into at least the first normal operating position.

In order that the lock 5 of the door 2 of the vehicle 1 can now be opened in the powerless emergency operation, the user must first release the lock 5 of the door 2 using a mechanical emergency key. As can be seen in FIG. 3, for example, the handle 4 disposed in the actuation position allows such a mechanical emergency key to be inserted into the emergency lock cylinder 8, in order to unlock the lock 5.

Figure 22:
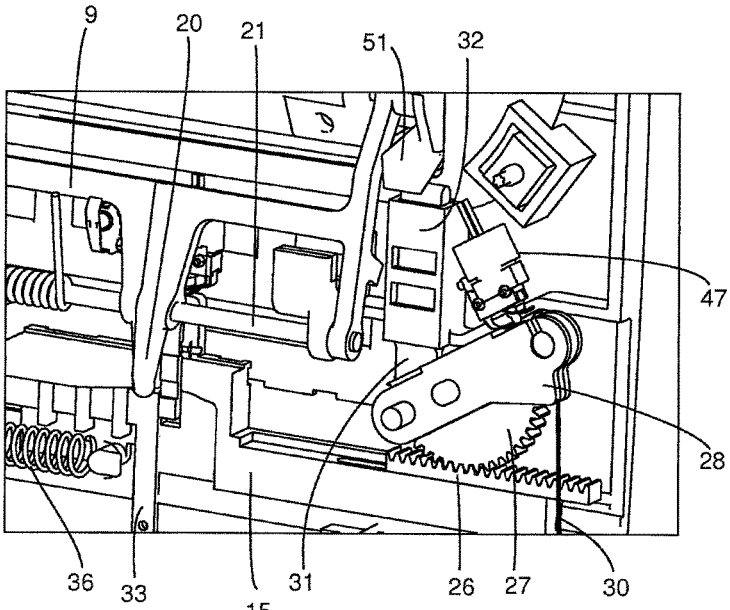
FIG. 22 shows an enlarged view of components of the door handle assembly for the powerless emergency operation with an actuated handle.
Figure 23:
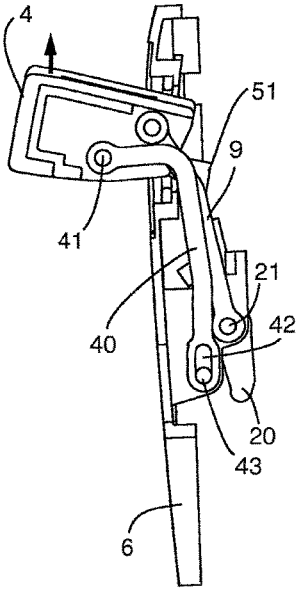
FIG. 23 shows a side sectional view of the door handle assembly from FIG. 21.

When the lock 5 has been unlocked using the emergency key, the lock 5 can be opened, in that the user pulls on the handle 4, or pivots the handle 4 about the rotational axis 41, respectively. In contrast to in the power driven normal operation, a pivoting of the handle 4 disposed in the actuation position of ca. 30° is necessary in the powerless emergency operation, in order to achieve the desired opening of the lock 5. By pulling on the handle 4, as is shown in FIGS. 22 and 23, the handle 4 is rotated about the rotational axis 41, by means of which a projection 51 formed on the handle 4 moves toward the gearwheel 27. This projection 51 pushes against the manipulation element 31 guided in the guide channel 32 toward the gearwheel 27, such that the manipulation element 31 moves toward the gearwheel 27, and presses thereby against the opening lever 28 non-rotatably retained on the gearwheel 27. As a result, the opening lever 28 is rotated out of the neutral position into the opening position depicted in FIG. 22, such that the Bowden cable 30 coupled to the lock 5 is actuated, and the lock 5 is opened. Accordingly, the handle 4 is functionally coupled, or connected, to the opening lever 28 via the manipulation element 31, such that in the powerless emergency operation, the handle 4 forces the manipulation element 31 against the opening lever 28 when the handle 4 disposed in its actuation position is actuated, and moves it out of the neutral position into the open position.

In summary, a door handle assembly 3 is described above, in which the handle 4 is deflected from its strake-flush position in a power driven normal operation, by means of which a user can actuate the handle 4, which is detected by sensors or switches, upon which the lock 5 of the door is opened electrically. The door handle assembly 3 is distinguished by its mechanical redundancy, which enables a powerless emergency operation, wherein the transmission element 15, the opening lever 28, and the handle 4 are allocated to functions for opening the lock 5 of the door 2 in both the power driven normal operation as well as in the powerless emergency operation.

The invention described above is not limited to the embodiments described and illustrated herein as a matter of course. It is clear that numerous modifications, obvious to the person skilled in the art with respect to the intended application, can be made to the embodiment depicted in the drawings, without abandoning the scope of the invention thereby. The person skilled in the art will recognize that the door handle assembly 3 according to the invention can be used not only on a door 2, but also on a hatch or a trunk of a motor vehicle. Everything contained in the description and/or depicted in the drawings belongs to the invention, including that which is obvious to the person skilled in the art deviating from the concrete example.

The invention claimed is:

1. A door handle assembly for a motor vehicle, comprising a handle mount attached to the inside of a door or hatch of the motor vehicle, a handle for opening the door or hatch of the motor vehicle, wherein the handle is disposed such that the handle is flush with the door or hatch when in a standby position, and protrudes out of the door or hatch when in an actuation position, a lever element that moves the handle out of the standby position into the actuation position, wherein a first longitudinal end of the lever element is pivotably supported on the handle mount, and a second longitudinal end of the lever element supports the handle, and a transmission element, which is moveably supported on the handle mount, and is functionally connected to the lever element, wherein the transmission element is designed such that, for a power driven operation, the transmission element is adapted to be moved from a home position into a first operating position, in which the transmission element moves the handle via the lever element into the actuation position via a drive, and wherein an actuation of the handle disposed in its actuation position opens a vehicle lock, wherein, for a powerless emergency operation, the transmission element is designed such that the transmission element is adapted to be moved from the home position into an emergency operating position, in which the transmission element pivots the lever element, in order to move the handle into the actuation position.

2. The door handle assembly according to claim 1, wherein an opening lever that is rotatably supported on the handle mount is coupled to the vehicle lock, wherein an actuation of the handle, when the handle is disposed in its actuation position, moves the opening lever out of a neutral position into an opening position that opens the vehicle lock.

3. The door handle assembly according to claim 2, wherein the drive moves the transmission element from the home position into the first operating position in the power driven operation.

4. The door handle assembly according to claim 3, wherein a proximity sensor is disposed in or on at least one of the handle and the handle mount, wherein the proximity sensor is designed such that the proximity sensor is connected for data transfer to the drive, such that in the power driven operation, the proximity sensor activates the drive when the proximity or touch of a legitimized user has been detected, and the drive then moves the transmission element from the home position into the first operating position.

5. The door handle assembly according to claim 2, wherein a detection means is provided, wherein the detection means is designed such that it is connected to the drive for data transfer, such that, in the power driven operation, when a manual actuation of the handle disposed in its actuation position has been detected, the detection means activates the drive for moving the transmission element out of the first operating position into a second operating position, in which the transmission element interacts with the opening lever that opens the vehicle lock.

6. The door handle assembly according to claim 2, wherein the opening lever is non-rotatably attached to a gearwheel rotatably supported on the handle mount, wherein the gearwheel is engaged with a gear rack supported on the transmission element.

7. The door handle assembly according to claim 6, wherein when the transmission element is moved from the first operating position into a second operating position, the gear rack is moved by the transmission element, and path drives the gearwheel for at least a portion of its movement and forces the opening lever into the opening position.

8. The door handle assembly according to claim 6, wherein the gear rack has a movement pin, which is inserted in a recess in the transmission element, wherein the gear rack is adapted to move in relation to the transmission element in the recess.

9. The door handle assembly according to claim 2, wherein the transmission element is pretensioned toward the emergency operating position, and a latching means is pivotably supported on the transmission element, wherein the latching means blocks a movement of the transmission element from the home position toward the emergency operating position when the latching means is in a latching position.

10. The door handle assembly according to claim 9, wherein the handle is adapted to be moved from the flush standby position into a releasing position, recessed in the door or hatch, in the powerless emergency operation.

11. The door handle assembly according to claim 10, wherein, in the releasing position, a releasing projection formed on the lever element, which releasing projection extends over the first longitudinal end of the lever element, and which releasing projection defines a pivot axis for the lever element, extends away from the second longitudinal end of the lever element, forcing the latching means out of its latching position, such that the transmission element, which is pretensioned toward the emergency operating position, can move into the emergency operating position.

12. The door handle assembly according to claim 11, wherein the transmission element moves the releasing projection along a first deflection surface when the transmission element moves from the home position toward the first operating position, and moves the releasing projection along a second deflection surface when the transmission element moves from the home position toward the emergency operating position, such that the lever element pivots about the pivot axis, and the handle moves into the actuation position.

13. The door handle assembly according to claim 12, wherein the first deflection surface and the second deflection surface are each designed as a surface running diagonally away from the handle mount, which force the releasing projection away from the handle mount when the transmission element is moved into the first operating position or into the emergency operating position, and consequently pivots the handle into the actuation position.

14. The door handle assembly according to claim 2, wherein the handle is functionally connected to the opening lever via a manipulation element, such that in the powerless emergency operation, the handle forces the manipulation element against the opening lever by means of an actuation of the handle disposed in its actuation position, and moves it out of the neutral position into the opening position.

15. The door handle assembly according to claim 1, wherein the movement of the transmission element from the home position into the first operating position is a linear movement, which movement runs in a direction opposite to the movement of the transmission element from the home position into the emergency operating position.

* * * * *